US005315311A

United States Patent [19]

Honkala

[11] Patent Number: 5,315,311

[45] Date of Patent: May 24, 1994

[54] METHOD AND APPARATUS FOR REDUCING POWER CONSUMPTION IN AN AC-EXCITED ELECTROLUMINESCENT DISPLAY

[75] Inventor: Jorma Honkala, Kauniainen, Finland

[73] Assignee: Planar International OY, Espoo, Finland

[21] Appl. No.: 717,396

[22] Filed: Jun. 19, 1991

[30] Foreign Application Priority Data

Jun. 20, 1990 [FI] Finland ..... 903103

[51] Int. Cl.[5] ..... G09G 3/30

[52] U.S. Cl. ..... 345/76; 345/212

[58] Field of Search ..... 340/781, 811, 812, 813, 340/814, 793, 719; 315/169.3; 345/212, 76-80

[56] References Cited

U.S. PATENT DOCUMENTS

| | | | |
|---|---|---|---|
| 4,636,789 | 1/1987 | Yamaguchi et al. | 340/781 |
| 4,733,228 | 3/1988 | Flegal | 340/781 |
| 4,801,920 | 1/1989 | Ohba et al. | 340/781 |
| 5,027,040 | 6/1991 | Ikeda et al. | 315/169.3 |
| 5,093,654 | 3/1992 | Swift et al. | 340/781 |

FOREIGN PATENT DOCUMENTS 62447 8/1982 Finland .

OTHER PUBLICATIONS

Linear and Interface Circuit Applications, vol. 2, Display Drivers & Data Transmission Line Circuit, TI, 1986, pp. 9-75.

ICs for Industrial Electronics, Data Book 1989/1990, Siemens, pp. 243-260.

Linear Integrated Circuits Data Book, 1987, Unitrode, pp. 3-107 to 3-112.

*Primary Examiner*—Richard Hjerpe
*Assistant Examiner*—Steve Saras
*Attorney, Agent, or Firm*—Jones, Day, Reavis & Pogue

[57] ABSTRACT

The present invention relates to a method and apparatus for driving an AC-excited thin-film electroluminescent display based on a display matrix of rows and columns, in which method each row of the display matrix is alternately driven by positive (Vwrp) and negative (Vwrn) row drive pulses in which the magnitudes of successive pulses are different, each column of the display matrix is driven individually by modulation voltage pulses synchronized to the row addressing sequence, said pulses having a maximum amplitude (Vm) and an "ON"-state polarity equal to that of the larger-magnitude row drive pulse. According to the invention in a limit-load situation the maximum amplitude of the modulation voltage (Vm) is allowed to drop, the amplitude of the smaller-magnitude row drive pulse (Vwrn) is feedback controlled from the modulation voltage (Vm) so that a drop in the maximum amplitude of the modulation voltage (Vm) is compensated by an increase of the magnitude of the smaller-amplitude row drive voltage (Vwrn), said increase being essentially equal to the drop in the modulation voltage (Vm), and the higher-amplitude row drive voltage (Vwrp) is maintained essentially constant. The circuit configuration according to the invention provides an essential reduction in the power consumption of the display.

8 Claims, 7 Drawing Sheets

METHOD AND APPARATUS FOR REDUCING POWER CONSUMPTION IN AN AC-EXCITED ELECTROLUMINESCENT DISPLAY

The present invention relates to a method in accordance with the preamble of claim 1 for reducing the power consumption of an AC-excited thin-film electroluminescent display.

The invention also concerns an apparatus capable of reducing power consumption of said display type.

The display structure to be driven is characterized by high capacitance of the display, typically of the order of 100 pF/mm$^2$ and matrix structure comprised of row and column lines.

FIG. 1 shows the block diagram of a typical electroluminescent (EL) display. The display unit illustrated comprises an EL panel, column and row driver circuits, column and row pulse generators, power supply, data handling and timing logic as well as necessary filter components. The power supply section converts a low-voltage input to medium-voltage outputs required by the EL display. Such voltages are indicated in the diagram by Vm, Vwrp and Vwrn. Appropriate voltage levels can be, e.g., 40 . . . 50 V for Vm, 170 . . . 195 V for Vwrp and −120 . . . −155 V for Vwrn. Additionally, the power supply section can provide other necessary voltages.

The voltages are generally applied to the row and column lines via dedicated pulse generators. However, particularly on the column side of the display, drive voltages can be applied directly via the driver circuits.

A disadvantage of the prior-art technology is that high power consumption of the display can significantly curtail the operational time of portable applications such as laptop computers running in the battery-powered mode.

Therefore, it is an object of the present invention to overcome problems associated with the high power consumption and to achieve a novel method and apparatus for reducing the power consumption of AC-excited electroluminescent displays.

The invention is based on the limitation of maximum power consumption of the display by reducing display contrast while maintaining the apparent display brightness at a constant level.

Furthermore, the circuitry according to the invention is based on limiting power output from that section of the power supply that generates the supply voltage Vm to a value sufficient for supplying column power at typical loads only. In special cases, e.g., when approximately half of the columns are driven to the ON state, the power supply output limitation sets on, allowing the voltage Vm to drop. The power supply section responsible for generating the row drive voltages Vwrn and Vwrp is dimensioned to supply full power required by the row driver circuits at all times. Furthermore, the positive row drive voltage Vwrp is maintained at a constant level, while the negative row drive voltage Vwrn is controlled by feedback from the voltage Vm so that the condition Vwrn = −(Vwrp-Vm) is maintained, which results in a constant luminance.

The circuitry shown in FIG. 5 in particular is based on a design, in which windings II and III of transformer Ml that are used for generating the voltages Vwrn and Vwrp are bifilar windings and winding II of transformer Ml is connected in series with the voltage Vm.

The invention provides outstanding benefits.

Firstly, the maximum power consumption of the display is reduced, whereby both the operating temperature of driver circuits in particular is decreased and the need for cooling is relaxed. These facts contribute to increased reliability of the display. Conversely, the operational temperature range of the display can be widened. Component costs are also smaller. Higher component packing densities are achieved. The display can be driven from a power supply of lower power output and smaller size. Consequently, a longer operational time is attained for operation in the battery-powered mode.

The invention is next examined in detail with the help of the attached drawings and exemplifying embodiments illustrated therein.

DESCRIPTION OF THE PREFERRED EMBODIMENT

The following description deals with generation of drive voltages for an on/off-type display. The display is written row-by-row by applying to the addressed row a row selection pulse formed from the positive or negative supply voltage (Vwrp or Vwrn, respectively). Rows not addressed are left floating. The column lines are driven by modulation voltage pulses formed from the luminance modulation voltage Vm, whereby the amplitude of modulation pulse for each column line is controlled to attain a desired luminance level. If the row selection pulse has negative polarity, a column line to drive a pixel to the "ON" state receives the modulation voltage (Vm), while a column line to drive a pixel to the "OFF" state is connected to the ground potential. For the next row driven by a positive-polarity row selection pulse, the column lines to drive a pixel to the "ON" state are correspondingly connected to the ground potential and the column lines to drive a pixel to the "OFF" state are raised to the modulation voltage Vm.

Thus, for a row selection pulse of positive polarity, the "ON"-state pixel is excited by the voltage Vwrp and the "OFF"-state pixel by the voltage Vwrp - Vm. For a row selection pulse of negative polarity, these excitation voltages are Vm - Vwrn and Vwrn, respectively. As soon as all the rows, that is, one full field has been written, the write sequence is restarted from the first row. This subsequent new field is driven by pulses of opposite polarity with respect to those used during the preceding field. Such a symmetric drive scheme is described closer in reference /1/.

If luminance levels with different intensity levels (gray levels) are desirable, either the amplitude or duration of the modulation voltage Vm can be varied to attain the desired gray levels. The former of these methods is called the pulse amplitude modulation, while the latter is called the pulse width modulation.

Figure 1:
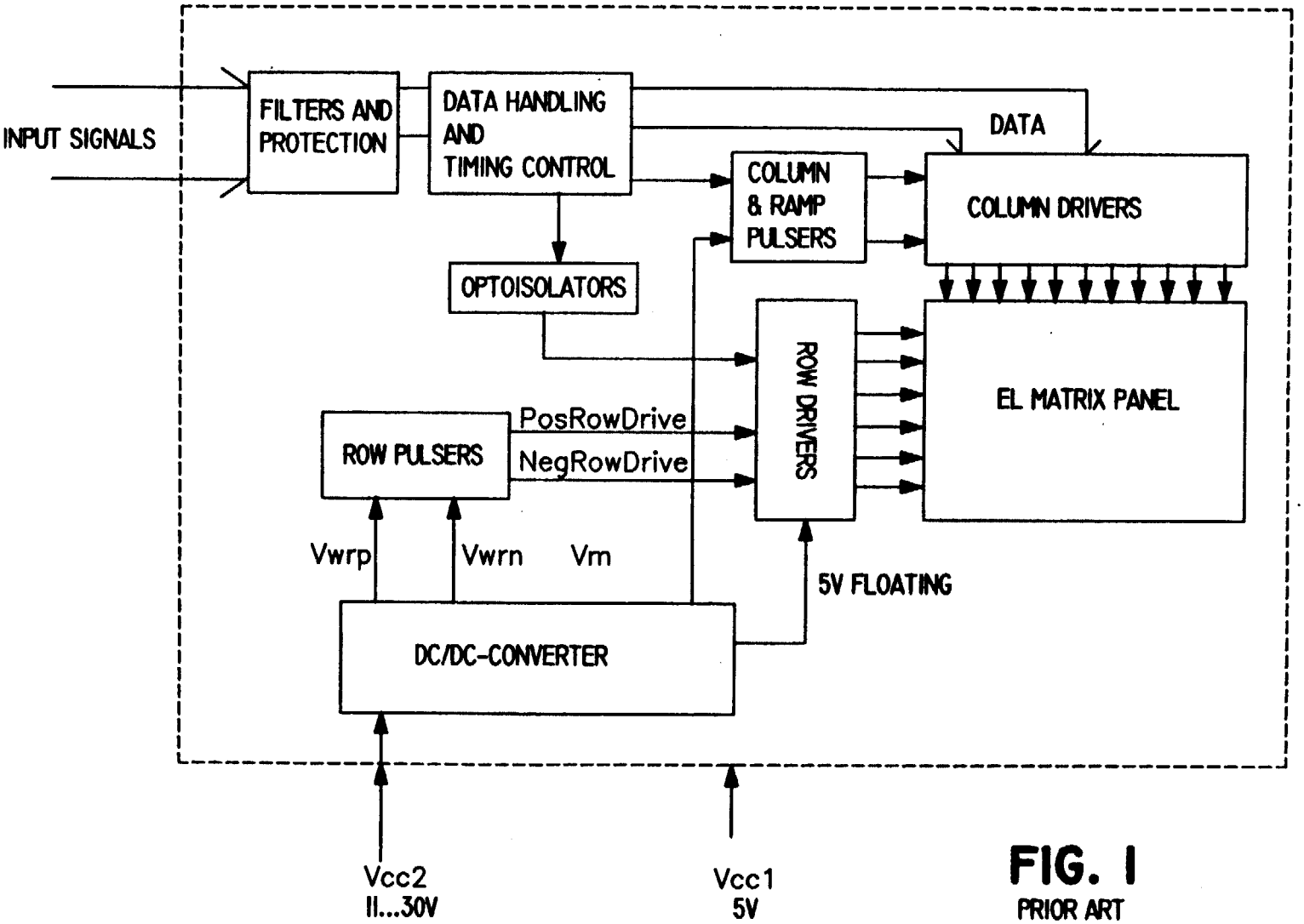
FIG. 1 PRIOR ART
FIG. 1 shows a block diagram of a hardware environment suitable for the implementation of the invention.
Figure 2:
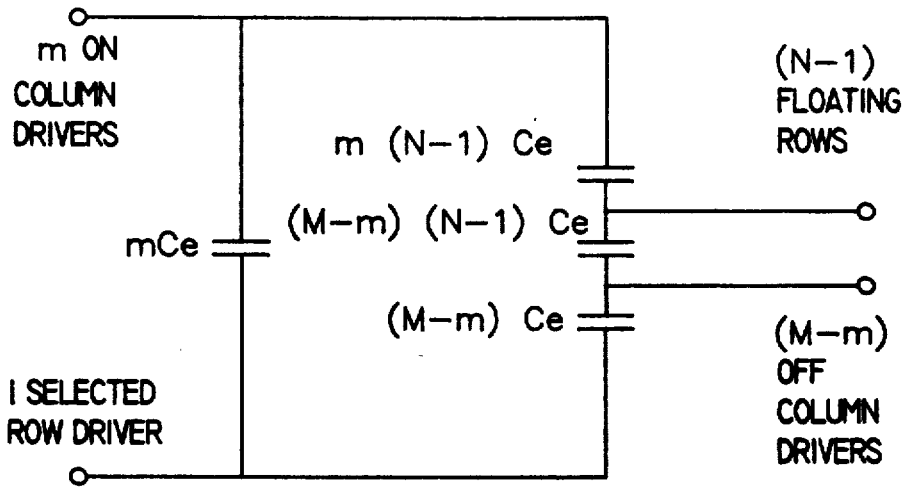
FIG. 2 PRIOR ART
FIG. 2 shows an equivalent electric circuit for a conventional electroluminescent display.

FIG. 2 shows the equivalent electric circuit of an EL display described in reference /2/. In the diagram, N denotes the total number of rows, M is the total number of columns and m is the number of "ON"-state columns.

The power consumption of an EL display can be approximated by the formula $$Ptot = Pmod + Pwr + Plog$$

where

Pmod is the drive power of columns

Pwr is the drive power of rows

Plog is the power consumption of control logic

The major portion of the power is consumed in modulation, because the capacitive load on the column side is vastly greater than that posed by rows. Typical power consumption levels are, for instance, approx. 1 W for Plog, 3 W for Pwr and 15 W for Pmod.

In the interest of reductions in power consumption it is therefore essential to find means for limiting the modulation power.

The maximum value of modulation power can approximated by the formula $$Pmod = k^* \, Cpanel/4^* \, (Vm)^{2*} \, f$$

where

Vm is the modulation voltage

Cpanel is the total capacitance of the EL panel f is the line frequency k is a constant (=1 if no energy power saving scheme is applied)

Figure 3:
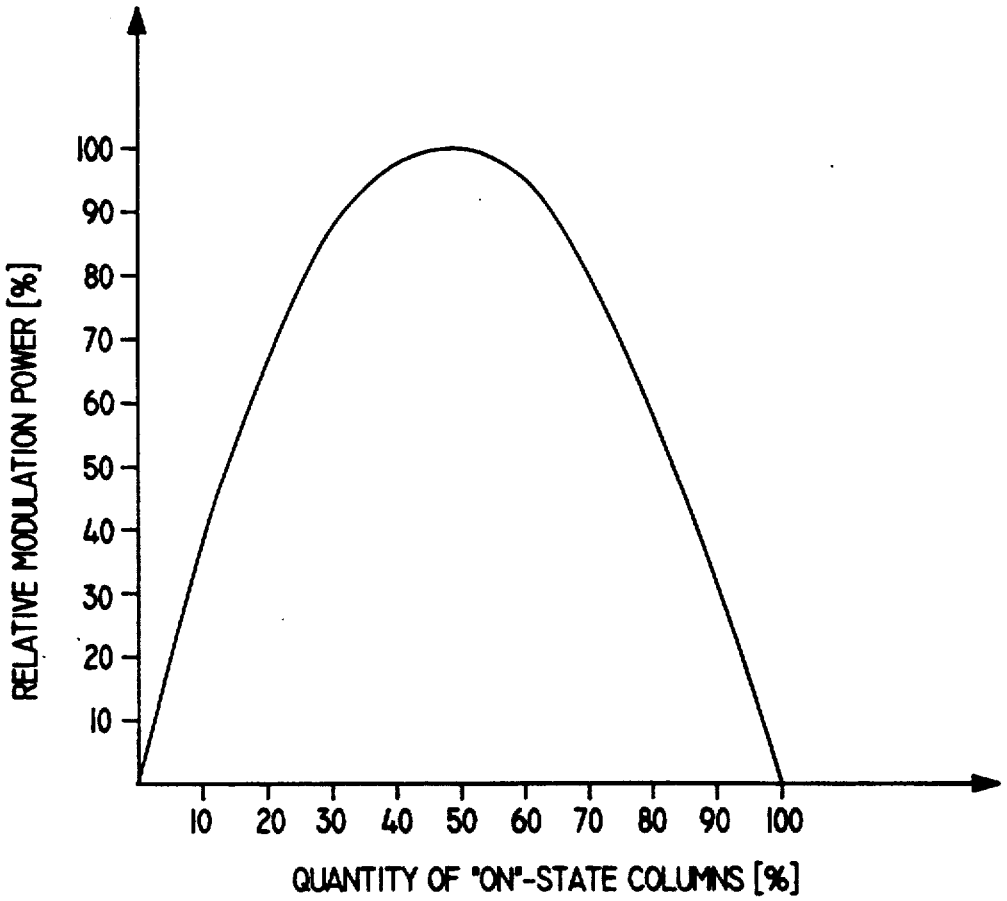
FIG. 3 PRIOR ART
FIG. 3 shows a graph computed from the equivalent electric circuit according to FIG. 2 for the relative modulation power consumption of the display as a function of the columns driven to the "ON" state.
Figure 4A:
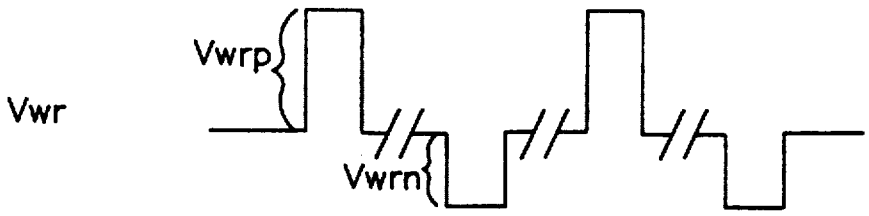
FIG. 4(a–d) shows the pulse sequences applied in the implementation of the invention.
Figure 4B:
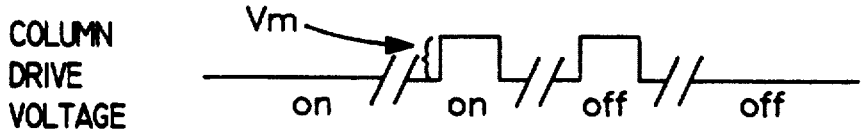
Figure 4C:
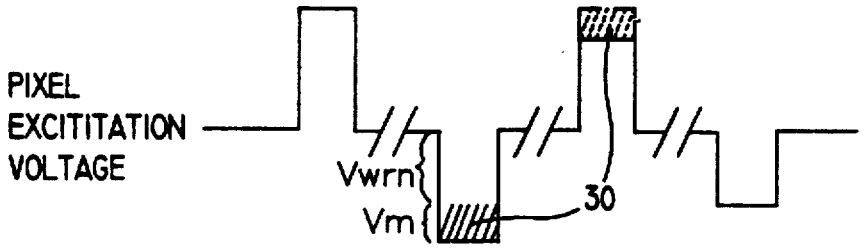
Figure 4D:
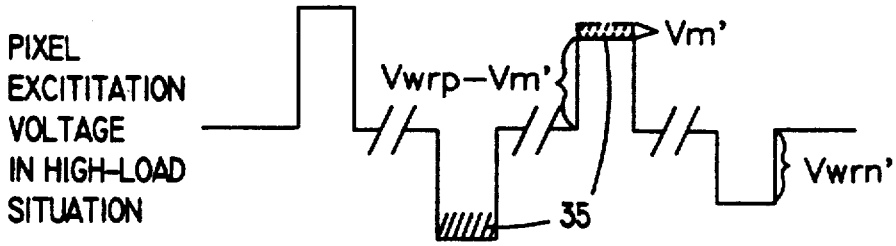

FIG. 3 shows the relative modulation power computed from the equivalent electric circuit according to FIG. 2 as a function of "ON"-state columns. The diagram does not include the power consumption (very low) related to generation of luminous energy nor internal losses related to the efficiency of the power supply. Power consumption peaks to a maximum in a situation where half of the columns are in the "ON" state and half in the "OFF" state. For typical displayed data the actual power consumption remains at a much lower level (by approx. 30 . . . 50%).

FIG. 4 illustrates at a diagrammatic level control sequences a, b, c and d related to the implementation of the invention, whereby the sequences are based on the above-described functional operation of the electroluminescent display. The uppermost sequence a in the diagram depicts the row write pulses of a row over four successive write cycles. In the sequence, the row is addressed alternately by positive row drive pulses Vwrp and negative row drive pulses Vwrn. Pulse amplitudes are determined by DC voltages Vwrp and Vwrn, which designations in the context of this description also refer to said pulses. The next sequence b in the diagram depicts the column modulation voltage Vm applied to the pixel controlled according to the uppermost sequence. The pixel being discussed herein is set to the "ON" state for first two pulses and to the "OFF" state for last the two pulses. The next sequence c depicts the excitation voltage across the pixel. The effect of the modulation voltage Vm is shown by a hatched portion 30. At the second pulse, the modulation pulse contributes additively to the magnitude of the amplitude, while at the third pulse the effect is subtractive. The next, the lowermost sequence d in the diagram again depicts the excitation voltage across the pixel in a special situation in which the modulation voltage Vm' is clipped by approx. 50% in accordance with the invention. The contribution of modulation voltage Vm' to the excitation voltage of the pixel is shown by hatched area 35. As is evident from the last sequence, the circuit configuration according to the invention maintains constant luminance of the display, allowing only a reduction in contrast as the background brightness increases when the amplitude of the negative row drive voltage Vwrn' is increased.

Figure 5:
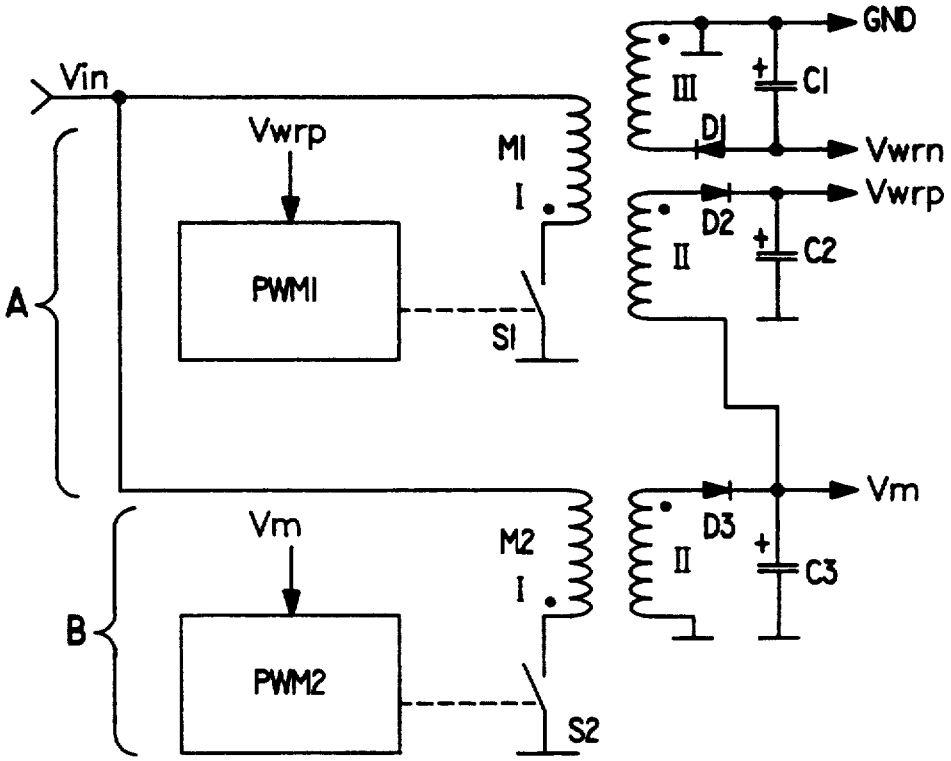
FIG. 5 shows a circuit according to the invention in a partially block-diagrammatic form.

FIG. 5 shows an example of the implementation of the circuit according to the invention. Here, elements PWM1, M1, S1, D1, D2, C1 and C2 form a flyback-type voltage converter A employed for generating the row write voltages (Vwrn and Vwrp). Feedback to element PWMI is applied from voltage Vwrp, which in the described implementation is maintained at a constant level. When required, however, it is possible to adjust this voltage to an appropriate level for different display types. The converter is a conventional voltage-controlled flybacktype converter operating with discontinuous current of the inductance. Element PWMI is a pulse-width modulator that drives switch S1 at a constant repetition rate. Element M1 is a transformer with flyback windings. Dots in the diagram designate the winding ends of equal phase. Elements D1 and C1 at the secondary side provide filtration for the voltage Vwrn, while elements D2 and C2 serve for the filtration of the voltage Vwrp. Windings II and III of Ml are bifilar windings with equal number of turns. Output currents from the voltage lines Vwrp and Vwrn have equal orders of magnitude (10 . . . 30 mA). Due to this fact, the output voltages from the windings II and III are approximately equal. Converter A is dimensioned for an output power capability sufficient to feed the drive power required by the row pulsers at any instant.

Elements PWM2, M2, S2, D3 and C3 form a converter B which is used for generating the modulation voltage (Vm). Feedback to the converter is taken from the modulation voltage Vm. The converter is dimensioned to deliver sufficient output power for generation of full modulation voltage in typical situations.

In special situations (e.g., when approximately half of the columns are driven to the "ON" state) that present a power load above the normal level, the power output capability of the converter B is insufficient, thereby allowing the modulation voltage to drop so much as to bring the modulation power consumed by the display to be compatible with the power output of converter B under power limitation. In a maximumload situation, the modulation voltage Vm can thus drop by, e.g., 50%. The power output limit, at which the modulation voltage starts dropping, can be said to be, e.g., approx. 65 . . . 85%, preferably approx. 75% of the maximum total power level Ptot of the display, determined in a situation without clipping of the modulation voltage Vm. The proportion of the actual modulation power Pmod in said total power is typically of the order of approx. 70 . . . 90% without power limiting. The power output capability of converter B can be appropriately dimensioned by using components of sufficient precision, or alternatively, by adjustment. In the present exemplifying circuit, adjustment means is implemented by altering the drive pulse duty ratio of switch S2. In order to eliminate the effect of the input voltage on the output power, the pulse duty ratio must also be varied according to changes in the input voltage (feed-forward configuration). In the current control mode of the switch control the adjustment is performed by altering the current threshold at which S2 is controlled to the "OFF" state. The lower end of winding II of transformer Ml is connected to the modulation voltage. When Vm is decreased at an increasing power load, Vwrp is nevertheless maintained at a constant level, whereby the voltage over winding II increases, thus forcing the voltage over bifilar winding III to increase. Therefore, Vwrn changes as much as Vm. This arrangement retains a constant excitation voltage over "ON"-state pixels, thus maintaining constant brightness. Excitation voltage over "OFF"-state pixels increases, thus increasing the background brightness.

In order to maintain a constant excitation voltage across an "ON"-state pixel, voltage Vwrn must change simultaneously with the changes of Vm, which necessitates a smaller time constant of voltage change for Vwrn. If Vm changes rapidly with a load change when, e.g., half of pixels on a few successive rows are in the "ON" state, this causes horizontal shadow effects, because background brightness at this area would be higher than in other parts of display as a result of contrast control. Due to this fact, voltage Vm must be designed to ramp at a sufficiently slow rate of change.

Figure 6:
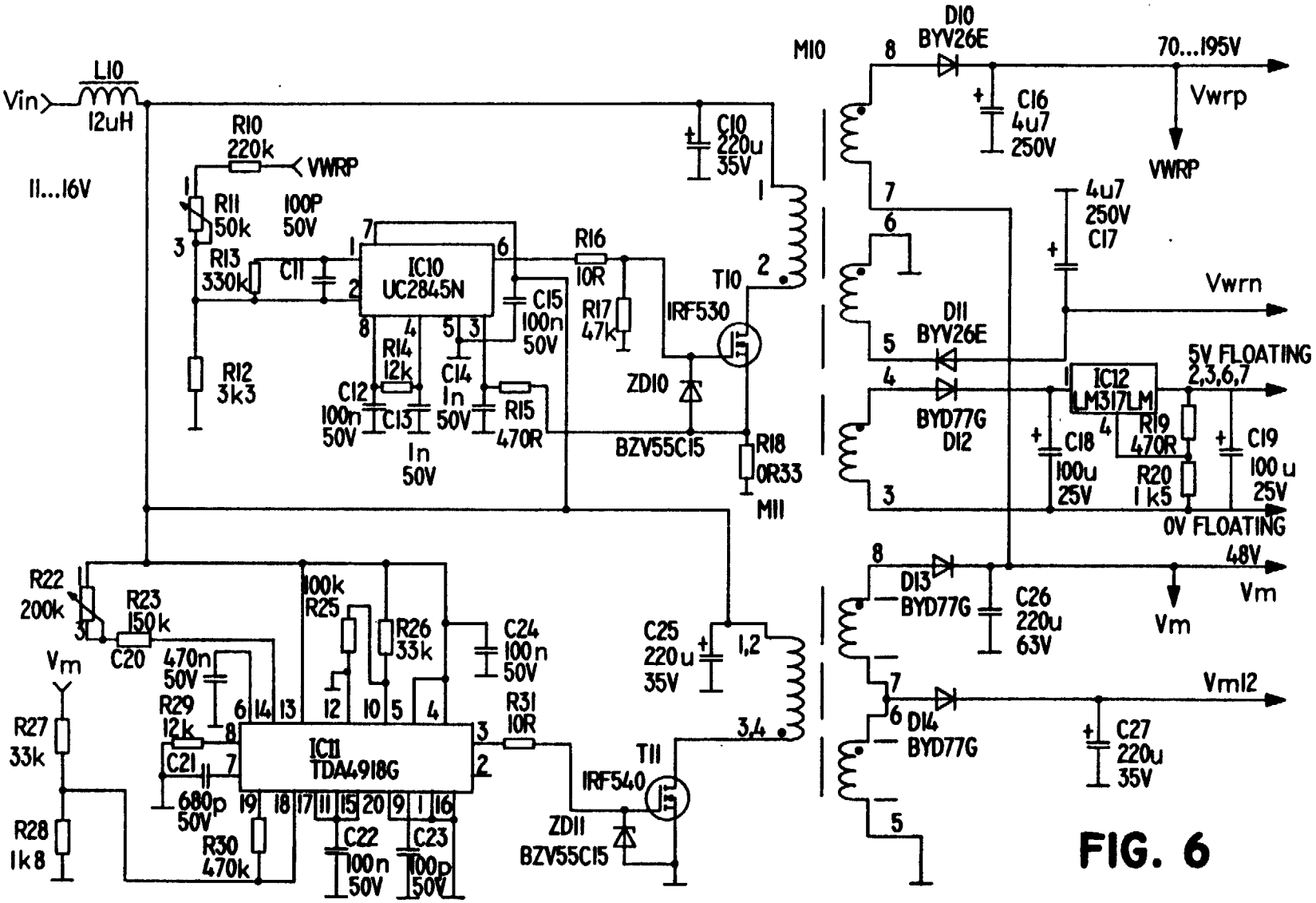
FIG. 6 shows in detail the circuit illustrated in FIG. 5.

FIG. 6 shows a detailed circuit diagram of the circuit implementation related to FIG. 5. In difference to the above description, this implementation, however, uses currentcontrolled feedback of integrated circuit IC10. In the configuration of this diagram, circuit IC10 corresponds to PWM1, T10 to S1, C16 to C2, C17 to Cl, of the components in FIG. 5, respectively. Transformers M10 and M11 of this circuit correspond to transformers M1 and M2, of FIG. 5. D10 corresponds to D2 and D11 to D1, of FIG. 5. IC11 corresponds to PWM2, T11 to S2, and D13 to D3, and C26 to C3, of FIG. 5. A trimmer potentiometer R11 is employed for adjusting Vwrp to an appropriate level for different display types. This adjustment also simultaneously controls Vwrn. R14 and C13 determine the switching frequency of IC10. This circuit employs M10 for generating the supply voltage required by the row driver circuits. Voltage Vm is determined by the voltage division ratio of resistors R27 and R28. For the component values employed in the circuit, Vm will be approx. 48 V. In the circuitry surrounding ICII, the switching frequency is determined by R29 and C21. Components R22+R23 and C23 determine the pulse duty ratio, and correspondingly, the maximum output power which can be accurately adjusted by means of trimmer potentiometer R22. In this circuit M11 also provides voltage Vm/2 that can be used in energy recovery circuits.

The operation of circuit TDA4918G is presented in reference 3/. Circuit UC2845 is described in reference /4/.

Figure 7:
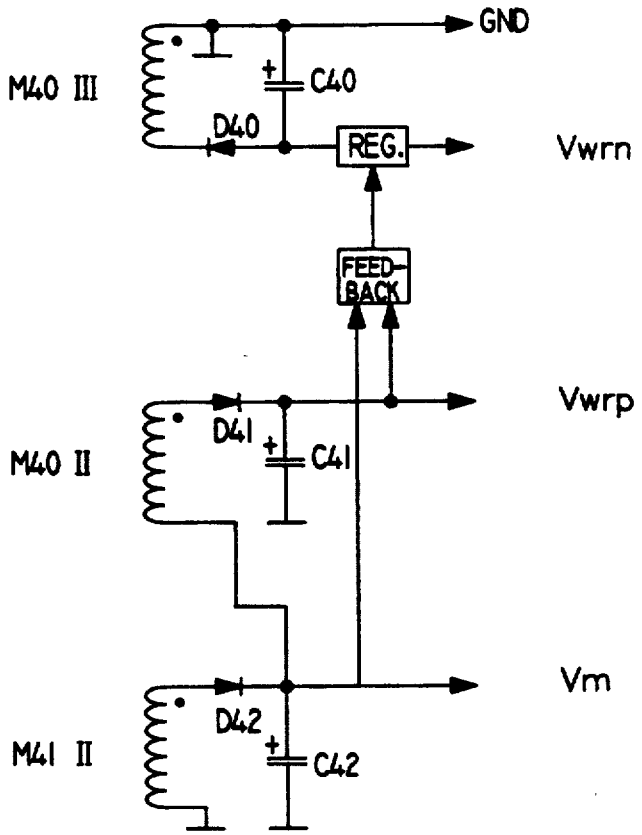
FIG. 7 shows an alternative circuit according to the invention.

FIG. 7 shows a circuit diagram in which postregulation is employed to replace the bifilar winding. Herein, the voltage Vwrn is controlled by feedback from voltages Vm and Vwrp. Feedback from voltage Vwrp is not necessary if Vwrn is adjusted separately.

Figure 8:
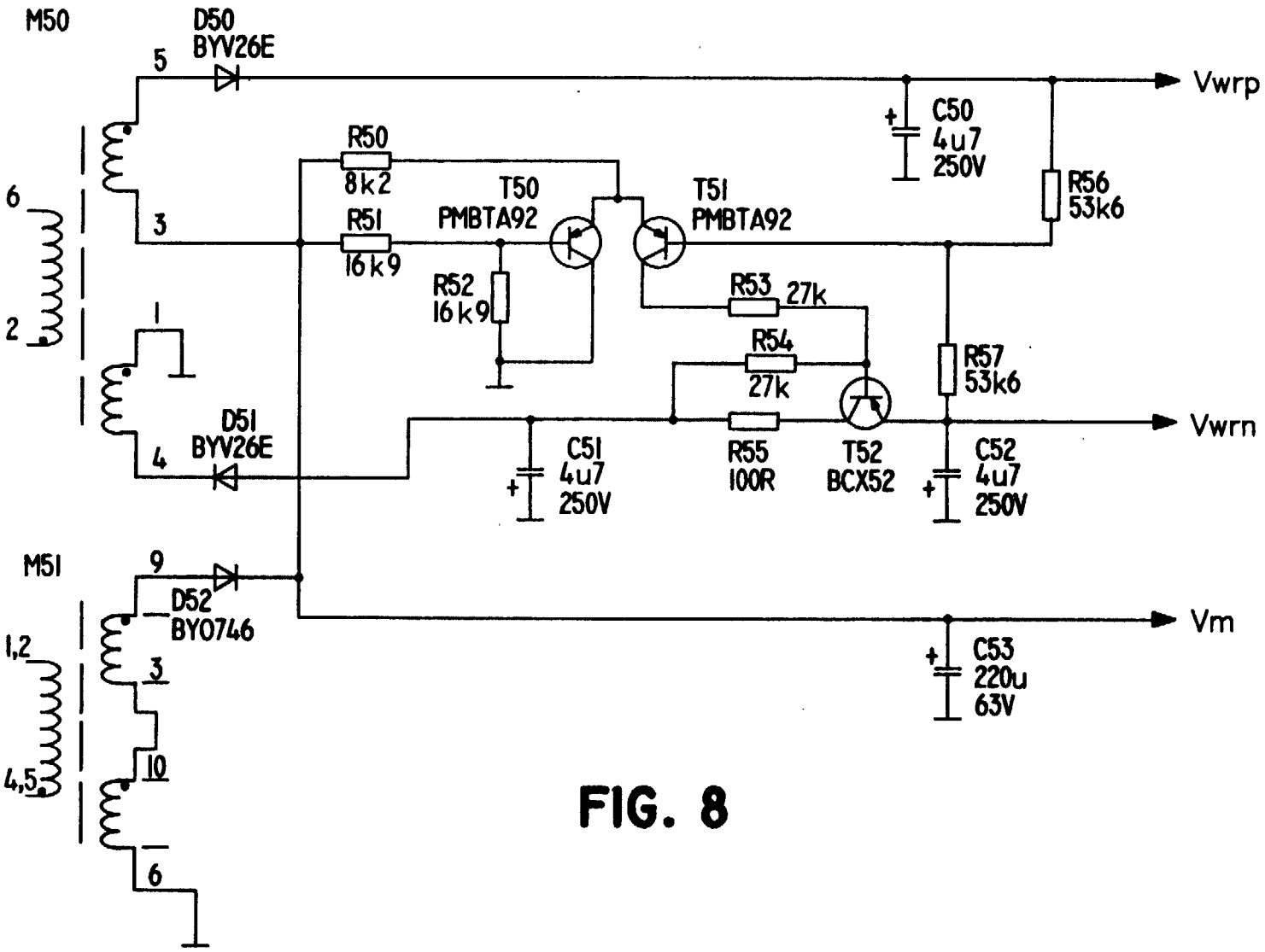
FIG. 8 shows in detail the circuit illustrated in FIG. 7.

FIG. 8 shows an exemplifying circuit in detail for guideline component values. Omitted from this example is the control circuits of the primary side, since this part of the circuit corresponds to that shown in FIG. 6.

The resistive divider formed by R51 and R52 is employed to form a voltage Vm/2 which is the arithmetic mean of Vwrn and Vwrp. This voltage is buffered by T50 and T51. Voltage division at base of T51 is formed by means of resistors R56 and R57. Assuming that voltage Vwrn is too low, voltage at base of T51 starts increasing, whereby base current of T51 starts decreasing, thus forcing collector current of T51 to decrease, whereby voltage over R54 decreases, thereby controlling Vwrn to a more negative value. Resultingly, R57 pulls down base voltage of T51, thus increasing current through T51. As is evident from the above description, the circuit formed by R56, R57 and T51 serves to regulate voltage Vwrn. If R56 and R57 are equal, Vwrn is forced toward the value −(Vwrp-V-m) As a result, Vwrn and Vwrp are offset by an equal magnitude of voltage from the potential at base of T51. If Vm now is decreased and Vwrp maintained constant, R56 tends to pull up base voltage of T51, whereby collector current of T51 is decreased, and Vwrn is resultingly controlled toward a more negative value until balance is attained.

Figure 9:
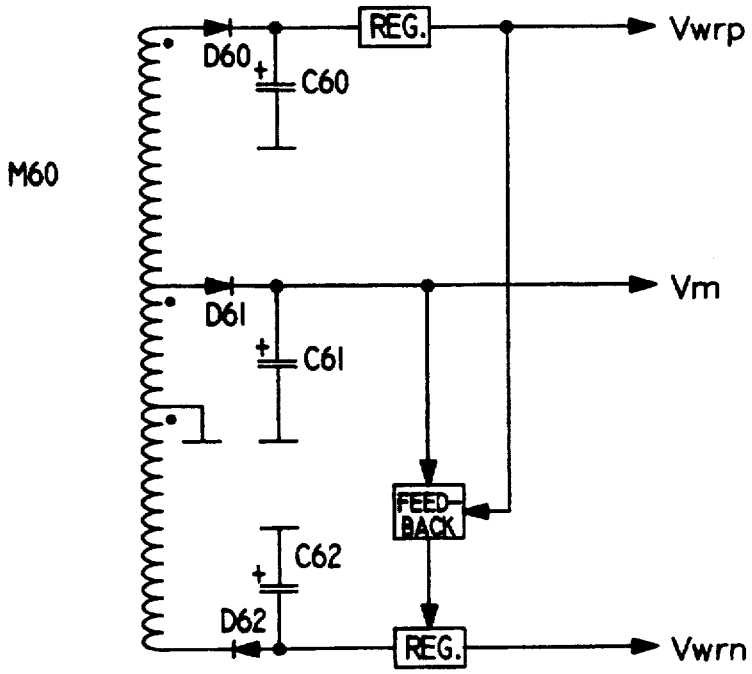
FIG. 9 shows diagrammatically another circuit according to the invention.

FIG. 9 shows diagrammatically an implementation employing a single transformer only. In this configuration both voltages Vwrp and Vwrn require postregulation. As in the above circuitry, feedback must be taken from voltage Vm only; complementary feedback from the voltage Vwrp offers, however, the benefit that voltage Vwrn needs no adjustment. The use of this circuit is hampered by the fact that high voltage drops and, consequentially, high power dissipations are imposed on the series regulators.

The circuit implementation according to the invention also offers the possibility of polarity inversion of the row control voltages. Hereby also the modulation voltage must be inverted to have negative polarity; otherwise a DC component will arise. An essential requirement set for the display to be used in conjunction with the invention is that the display modulation voltage must have equal polarity with the largeramplitude row drive voltage.

What is claimed is:

1. A method for driving an AC-excited thin-film electroluminescent display based on a display matrix of rows and columns wherein each row of the display matrix is alternately driven by pulses generated from positive and negative row drive voltages in which the magnitudes of successive pulses are different and wherein each column of the display matrix is driven individually by modulation voltage pulses synchronized to the row addressing sequence, the modulation voltage pulses having a variable amplitude and a polarity equal to that of the larger row drive pulse, the method comprising the steps of:

reducing the maximum amplitude of the modulation voltage during a limit-load situation of the display;

controlling the amplitude of the smaller magnitude row drive voltage pulse with feedback from the modulation voltage to increase the magnitude of the smaller row drive voltage pulse with a drop in the amplitude of the modulation voltage, the increase being essentially equal to the reduction in the modulation voltage; and maintaining the higher amplitude row drive voltage pulse essentially constant to provide a constant luminescence to the display.

2. A method according to claim 1 further comprising the step of reducing the modulation voltage when the load of the display reaches a preset limit load of approximately 75% of the maximum total load presented by the display.

3. A method according to claim 1 further comprising the step of reducing the modulation voltage by approximately 50% during said maximum total load presented by the display.

4. A method according to claim 1 in which the row drive voltage of smaller magnitude of amplitude is the negative row drive voltage, the method further comprising the step of controlling the negative row drive voltage to have a magnitude approximately equal to the difference of the positive row drive voltage and the modulation voltage according to the equation $$V_{wrn} = -(V_{wrp} - V_m)$$

in order to maintain display brightness at a constant level and wherein $V_{wrn}$ is the negative row drive voltage, $V_{wrp}$ is the positive row drive voltage and $V_m$ is the modulation voltage.

5. An apparatus for driving an AC-excited thin-film electroluminescent display based on a display matrix of rows and columns having first elements for generating a positive row drive voltage and a smaller amplitude negative row drive voltage and second elements for generating a modulation voltage the apparatus comprising:

the second elements generating the modulation voltage such that in a limit-load situation of the display, the modulation voltage is allowed to decrease;

a feedback circuit connected from the second elements to the first elements generating the row drive voltages such that a decrease in the modulation voltage causes an increase in the magnitude of the smaller amplitude row drive voltage, the increase being essentially equal to the decrease in the amplitude of the modulation voltage; and the feedback circuit maintaining the higher amplitude row drive voltage substantially constant to provide a constant luminescence to the display.

6. An apparatus according to claim 5 wherein the first element for generating the row drive voltages comprises:

a pulse-width modulator;

a flyback transformer having a primary winding;

a first switch element coupling the first pulse-width modulator to the flyback transformer;

bifilar secondary windings on the flyback transformer for generating the negative and positive row drive voltages, each of the secondary windings having an upper end and a lower end and having an equal number of turns; and first rectifier means connected to the bifilar secondary windings for generating and smoothing the negative and positive row drive voltages.

7. An apparatus according to claim 6 wherein the second element for generating the modulation voltage comprises:

a second transformer having a primary winding;

a second pulse-width modulator for driving the primary winding of the second transformer;

a second switch element coupling the second pulse-width modulator to the primary winding of the second transformer to control the pulse duty cycle of the second transformer during limit-load situations of the display to reduce the modulation voltage;

a secondary winding on the second transformer having an upper end and a lower end and supplying the modulation voltage;

second rectifier means connected to the secondary windings of the second transformer for generating and smoothing the modulation voltage; and connector means coupling the lower end of the one of the bifilar secondary windings of the first transformer to the modulation voltage at the upper end of the secondary winding of the second transformer in order to attain a feedback control over the smaller amplitude row drive voltage.

8. An apparatus according to claim 7 wherein the time constant of amplitude change in the modulation voltage is longer than the time constant of amplitude change in the smaller amplitude row drive voltage.

* * * * *

UNITED STATES PATENT AND TRADEMARK OFFICE

CERTIFICATE OF CORRECTION

PATENT NO. : 5,315,311

DATED : May 24, 1994

INVENTOR(S) : Jorma Honkala

It is certified that error appears in the above-indentified patent and that said Letters Patent is hereby corrected as shown below:

Column 5, line 60, after "reference" and before "3/" insert --/--

Column 6, line 17, delete "-" between "Vm"

Signed and Sealed this

Fourteenth Day of March, 1995

*Attest:*

*Attesting Officer*

Bruce Lehman

BRUCE LEHMAN

*Commissioner of Patents and Trademarks*